US008276669B2

(12) United States Patent
Dykstra et al.

(10) Patent No.: US 8,276,669 B2
(45) Date of Patent: Oct. 2, 2012

(54) VARIABLE FLOW RESISTANCE SYSTEM WITH CIRCULATION INDUCING STRUCTURE THEREIN TO VARIABLY RESIST FLOW IN A SUBTERRANEAN WELL

(75) Inventors: Jason D. Dykstra, Carrollton, TX (US); Michael L. Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/792,146

(22) Filed: Jun. 2, 2010

(65) Prior Publication Data

US 2011/0297385 A1 Dec. 8, 2011

(51) Int. Cl.
*E21B 34/06* (2006.01)
*F15C 1/16* (2006.01)
*F15C 1/08* (2006.01)

(52) U.S. Cl. ..... 166/316; 166/319; 166/373; 166/386; 137/808; 137/809; 137/812; 137/834

(58) Field of Classification Search ..... 166/316, 166/319, 373, 386; 137/808, 812, 834, 809
See application file for complete search history.

(56) References Cited

U.S. PATENT DOCUMENTS 3,091,393 A 5/1963 Sparrow
3,282,279 A * 11/1966 Manion ..... 137/809
3,461,897 A 8/1969 Kwok
3,470,894 A * 10/1969 Rimmer ..... 137/809
3,474,670 A * 10/1969 Rupert ..... 73/861.32
3,489,009 A * 1/1970 Rimmer ..... 137/809
3,515,160 A * 6/1970 Cohen ..... 137/810
3,529,614 A * 9/1970 Nelson ..... 137/809
3,537,466 A * 11/1970 Chapin ..... 137/809
3,566,900 A 3/1971 Black
3,598,137 A * 8/1971 Glaze ..... 137/809
3,620,238 A * 11/1971 Kawabata ..... 137/810
3,670,753 A * 6/1972 Healey ..... 137/823
3,704,832 A * 12/1972 Fix et al. ..... 239/461
3,712,321 A * 1/1973 Bauer ..... 137/812
3,717,164 A * 2/1973 Griffin ..... 137/810
3,760,828 A * 9/1973 Kawabata ..... 137/809

(Continued)

FOREIGN PATENT DOCUMENTS

EP 0834342 A2 4/1998

(Continued)

OTHER PUBLICATIONS

Lee Precision Micro Hydraulics, Lee Restrictor Selector product brochure; Jan. 2011, 9 pages.

(Continued)

*Primary Examiner* — Jennifer H Gay
(74) *Attorney, Agent, or Firm* — Smith IP Services, P.C.

(57) ABSTRACT

A variable flow resistance system for use in a subterranean well can include a flow chamber having an outlet and at least one structure which resists a change in a direction of flow of a fluid composition toward the outlet. The fluid composition may enter the chamber in the direction of flow which changes based on a ratio of desired fluid to undesired fluid in the fluid composition. Another variable flow resistance system can include a flow chamber through which a fluid composition flows, the chamber having an inlet, an outlet, and a structure which impedes a change from circular flow about the outlet to radial flow toward the outlet.

52 Claims, 11 Drawing Sheets

U.S. PATENT DOCUMENTS

| | | | | | |
|---|---|---|---|---|---|
| 3,927,849 | A | * | 12/1975 | Kovalenko et al. | 244/3.22 |
| 3,942,557 | A | * | 3/1976 | Tsuchiya | 137/810 |
| 4,029,127 | A | * | 6/1977 | Thompson | 137/806 |
| 4,082,169 | A | * | 4/1978 | Bowles | 188/322.14 |
| 4,276,943 | A | | 7/1981 | Holmes | |
| 4,286,627 | A | * | 9/1981 | Graf | 137/810 |
| 4,291,395 | A | * | 9/1981 | Holmes | 367/83 |
| 4,323,991 | A | | 4/1982 | Holmes et al. | |
| 4,385,875 | A | | 5/1983 | Kanazawa | |
| 4,390,062 | A | | 6/1983 | Fox | |
| 4,418,721 | A | | 12/1983 | Holmes | |
| 4,557,295 | A | * | 12/1985 | Holmes | 137/813 |
| 4,562,867 | A | * | 1/1986 | Stouffer | 137/811 |
| 4,570,675 | A | * | 2/1986 | Fenwick et al. | 137/805 |
| 4,801,310 | A | * | 1/1989 | Bielefeldt | 210/788 |
| 4,846,224 | A | * | 7/1989 | Collins et al. | 137/810 |
| 4,848,991 | A | * | 7/1989 | Bielefeldt | 55/399 |
| 4,895,582 | A | * | 1/1990 | Bielefeldt | 55/337 |
| 5,076,327 | A | * | 12/1991 | Mettner | 137/809 |
| 5,303,782 | A | | 4/1994 | Johannessen | |
| 5,455,804 | A | | 10/1995 | Holmes et al. | |
| 5,482,117 | A | | 1/1996 | Kolpak et al. | |
| 5,570,744 | A | | 11/1996 | Weingarten et al. | |
| 6,015,011 | A | | 1/2000 | Hunter | |
| 6,112,817 | A | | 9/2000 | Voll et al. | |
| 6,345,963 | B1 | | 2/2002 | Thomin et al. | |
| 6,367,547 | B1 | | 4/2002 | Towers et al. | |
| 6,371,210 | B1 | | 4/2002 | Bode et al. | |
| 6,374,858 | B1 | * | 4/2002 | Hides et al. | 137/813 |
| 6,497,252 | B1 | | 12/2002 | Kohler et al. | |
| 6,622,794 | B2 | | 9/2003 | Zisk, Jr. | |
| 6,627,081 | B1 | | 9/2003 | Hilditch et al. | |
| 6,644,412 | B2 | | 11/2003 | Bode et al. | |
| 6,691,781 | B2 | | 2/2004 | Grant et al. | |
| 6,719,048 | B1 | | 4/2004 | Ramos et al. | |
| 7,011,101 | B2 | * | 3/2006 | Bowe et al. | 137/14 |
| 7,185,706 | B2 | | 3/2007 | Freyer | |
| 7,290,606 | B2 | | 11/2007 | Coronado et al. | |
| 7,409,999 | B2 | | 8/2008 | Henriksen et al. | |
| 7,537,056 | B2 | | 5/2009 | MacDougall | |
| 7,857,050 | B2 | | 12/2010 | Zazovsky et al. | |
| 2006/0131033 | A1 | | 6/2006 | Jeffrey et al. | |
| 2007/0028977 | A1 | | 2/2007 | Douglas | |
| 2007/0246407 | A1 | | 10/2007 | Richards et al. | |
| 2008/0041580 | A1 | | 2/2008 | Freyer et al. | |
| 2008/0041581 | A1 | | 2/2008 | Richards | |
| 2008/0041582 | A1 | | 2/2008 | Saetre et al. | |
| 2008/0041588 | A1 | | 2/2008 | Richards et al. | |
| 2008/0149323 | A1 | | 5/2008 | O'Malley et al. | |
| 2008/0169099 | A1 | | 7/2008 | Emil | |
| 2008/0283238 | A1 | | 11/2008 | Richards et al. | |
| 2008/0314590 | A1 | | 12/2008 | Patel | |
| 2009/0000787 | A1 | | 1/2009 | Bunker et al. | |
| 2009/0065197 | A1 | | 3/2009 | Eslinger | |
| 2009/0078427 | A1 | | 3/2009 | Patel | |
| 2009/0078428 | A1 | | 3/2009 | Ali | |
| 2009/0101354 | A1 | | 4/2009 | Holmes et al. | |
| 2009/0133869 | A1 | | 5/2009 | Clem | |
| 2009/0151925 | A1 | | 6/2009 | Richards et al. | |
| 2009/0226301 | A1 | * | 9/2009 | Priestman et al. | 415/145 |
| 2009/0250224 | A1 | | 10/2009 | Wright et al. | |
| 2009/0277650 | A1 | | 11/2009 | Casciaro et al. | |
| 2010/0300568 | A1 | * | 12/2010 | Faram et al. | 137/810 |
| 2011/0042091 | A1 | * | 2/2011 | Dykstra et al. | 166/316 |
| 2011/0042092 | A1 | * | 2/2011 | Fripp et al. | 166/319 |
| 2011/0079384 | A1 | | 4/2011 | Russell et al. | |
| 2011/0186300 | A1 | | 8/2011 | Dykstra et al. | |
| 2011/0198097 | A1 | | 8/2011 | Moen | |
| 2011/0203671 | A1 | * | 8/2011 | Doig | 137/1 |
| 2011/0214876 | A1 | * | 9/2011 | Dykstra et al. | 166/316 |
| 2011/0297384 | A1 | | 12/2011 | Fripp et al. | |
| 2011/0297385 | A1 | | 12/2011 | Dykstra et al. | |
| 2012/0048563 | A1 | | 3/2012 | Holderman | |
| 2012/0060624 | A1 | | 3/2012 | Dykstra | |
| 2012/0061088 | A1 | | 3/2012 | Dykstra et al. | |

FOREIGN PATENT DOCUMENTS

| | | | |
|---|---|---|---|
| EP | 1857633 | A2 | 11/2007 |
| EP | 2146049 | A2 | 1/2010 |
| WO | 0214647 | A1 | 2/2002 |
| WO | 03062597 | A1 | 7/2003 |
| WO | 2004033063 | A2 | 4/2004 |
| WO | 2008024645 | A2 | 2/2008 |
| WO | 2009052076 | A2 | 4/2009 |
| WO | 2009052103 | A2 | 4/2009 |
| WO | 2009052149 | A2 | 4/2009 |
| WO | 2009081088 | A2 | 7/2009 |
| WO | 2009088292 | A1 | 7/2009 |
| WO | 2009088293 | A1 | 7/2009 |
| WO | 2009088624 | A2 | 7/2009 |
| WO | 2010053378 | A2 | 5/2010 |
| WO | 2010087719 | A1 | 8/2010 |
| WO | 2011095512 | A2 | 8/2011 |
| WO | 2011115494 | A1 | 9/2011 |
| WO | 2012033638 | A2 | 3/2012 |

OTHER PUBLICATIONS

Tesar, V.; Fluidic Valves for Variable-Configuration Gas Treatment; Chemical Engineering Research and Design journal; Sep. 2005; pp. 1111-1121, 83(A9); Trans IChemE; Rugby, Warwickshire, UK.

Tesar, V.; Sampling by Fluidics and Microfluidics; Acta Polytechnica; Feb. 2002; pp. 41-49; vol. 42; The University of Sheffield; Sheffield, UK.

Tesar, V., Konig, A., Macek, J., and Baumruk, P.; New Ways of Fluid Flow Control in Automobiles: Experience with Exhaust Gas Aftertreament Control; 2000 FISITA World Automotive Congress; Jun. 12-15, 2000; 8 pages; F2000H192; Seoul, Korea.

International Search Report and Written Opinion issued Mar. 25, 2011 for International Patent Application Serial No. PCT/US2010/044409, 9 pages.

International Search Report and Written Opinion issued Mar. 31, 2011 for International Patent Application Serial No. PCT/US2010/044421, 9 pages.

Joseph M. Kirchner, "Fluid Amplifiers", 1996, 6 pages, McGraw-Hill, New York.

Joseph M. Kirchner, et al., "Design Theory of Fluidic Components", 1975, 9 pages, Academic Press, New York.

Microsoft Corporation, "Fluidics" article, Microsoft Encarta Online Encyclopedia, copyright 1997-2009, 1 page, USA.

The Lee Company Technical Center, "Technical Hydraulic Handbook" 11th Edition, copyright 1971-2009, 7 pages, Connecticut.

Office Action issued Jun. 26, 2011 for U.S. Appl. No. 12/791,993, 17 pages.

Stanley W. Angrist; "Fluid Control Devices", Scientific American Magazine, dated Dec. 1964, 8 pages.

Rune Freyer et al.; "An Oil Selective Inflow Control System", Society of Petroleum Engineers Inc. paper, SPE 78272, dated Oct. 29-31, 2002, 8 pages.

International Search Report with Written Opinion issued Jan. 5, 2012 for PCT Patent Application No. PCT/US2011/047925, 9 pages.

Stanley W. Angrist; "Fluid Control Devices", published Dec. 1964, 5 pages.

Office Action issued Oct. 27, 2011 for U.S. Appl. No. 12/791,993, 15 pages.

Office Action issued Nov. 3, 2011 for U.S. Appl. No. 13/111,169, 16 pages.

Office Action issued Nov. 2, 2011 for U.S. Appl. No. 12/792,117, 35 pages.

Office Action issued Oct. 26, 2011 for U.S. Appl. No. 13/111,169, 28 pages.

Office Action issued May 24, 2012 for U.S. Appl. No. 12/869,836, 60 pages.

Office Action issued May 24, 2012 for U.S. Appl. No. 13/430,507, 17 pages.

Patent Application and Drawings for U.S. Appl. No. 13/351,035, filed Jan. 16, 2012, 62 pages.

Patent Application and Drawings for U.S. Appl. No. 13/359,617, filed Jan. 27, 2012, 42 pages.

Patent Application and Drawings for U.S. Appl. No. 12/958,625, filed Dec. 2, 2010, 37 pages.

Patent Application and Drawings for U.S. Appl. No. 12/974,212, filed Dec. 21, 2010, 41 pages.

Office Action issued Mar. 7, 2012 for U.S. Appl. No. 12/792,117, 40 pages.

Patent Application and Drawings for U.S. Appl. No. 13/084,025, filed Apr. 11, 2011, 45 pages.
International Search Report with Written Opinion issued Apr. 17, 2012 for PCT Patent Application No. PCT/US11/050255, 9 pages.
International Search Report with Written Opinion issued Mar. 26, 2012 for PCT Patent Application No. PCT/US11/048986, 9 pages.

* cited by examiner

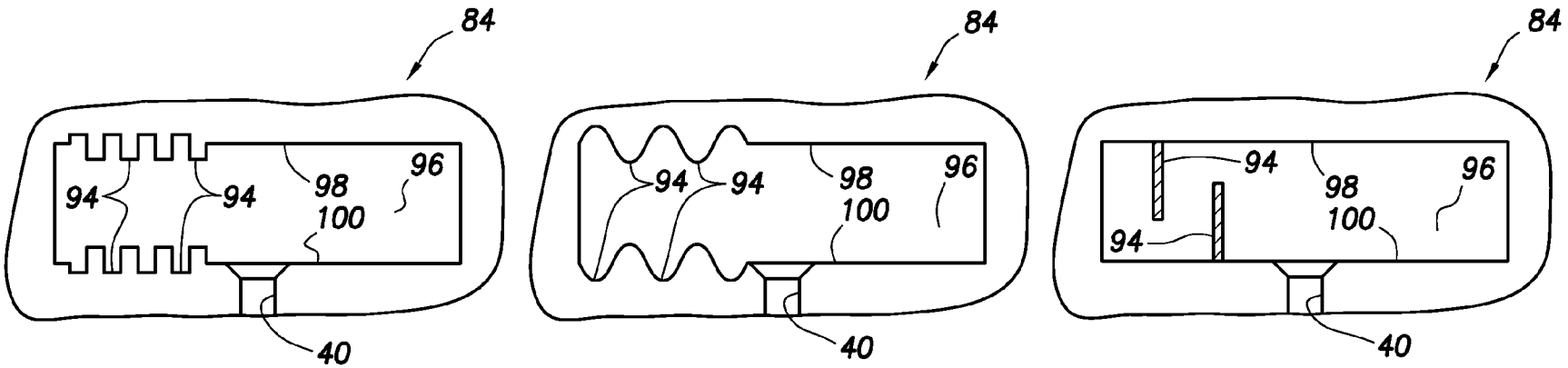
FIG.7D
FIG.7E
FIG.7F
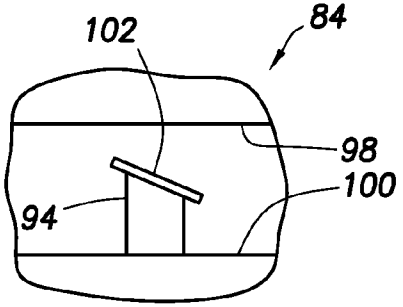
FIG.7H
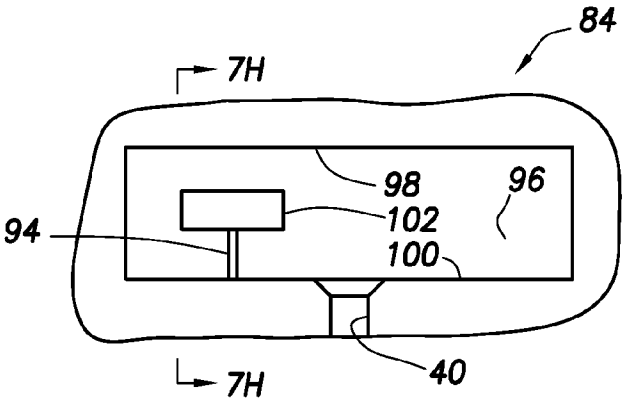
FIG.7G

VARIABLE FLOW RESISTANCE SYSTEM WITH CIRCULATION INDUCING STRUCTURE THEREIN TO VARIABLY RESIST FLOW IN A SUBTERRANEAN WELL

CROSS-REFERENCE TO RELATED APPLICATIONS

This application is related to prior application Ser. No. 12/700,685 filed on 4 Feb. 2010 (published as U.S. Publication No. 2011/0186300), which is a continuation-in-part of application Ser. No. 12/542,695 filed on 18 Aug. 2009 (now abandoned). The entire disclosures of these prior applications are incorporated herein by this reference for all purposes.

BACKGROUND

This disclosure relates generally to equipment utilized and operations performed in conjunction with a subterranean well and, in an example described below, more particularly provides for variably resisting flow in a subterranean well.

In a hydrocarbon production well, it is many times beneficial to be able to regulate flow of fluids from an earth formation into a wellbore. A variety of purposes may be served by such regulation, including prevention of water or gas coning, minimizing sand production, minimizing water and/or gas production, maximizing oil and/or gas production, balancing production among zones, etc.

In an injection well, it is typically desirable to evenly inject water, steam, gas, etc., into multiple zones, so that hydrocarbons are displaced evenly through an earth formation, without the injected fluid prematurely breaking through to a production wellbore. Thus, the ability to regulate flow of fluids from a wellbore into an earth formation can also be beneficial for injection wells.

Therefore, it will be appreciated that advancements in the art of variably restricting fluid flow in a well would be desirable in the circumstances mentioned above, and such advancements would also be beneficial in a wide variety of other circumstances.

SUMMARY

In the disclosure below, a variable flow resistance system is provided which brings improvements to the art of regulating fluid flow in a well. One example is described below in which flow of a fluid composition resisted more if the fluid composition has a threshold level of an undesirable characteristic. Another example is described below in which a resistance to flow through the system increases as a ratio of desired fluid to undesired fluid in the fluid composition decreases.

In one aspect, this disclosure provides to the art a variable flow resistance system for use in a subterranean well. The system can include a flow chamber through which a fluid composition flows. The chamber has at least one inlet, an outlet, and at least one structure which impedes a change from circular flow of the fluid composition about the outlet to radial flow toward the outlet.

In another aspect, a variable flow resistance system for use in a subterranean well can include a flow chamber through which a fluid composition flows. The chamber has at least one inlet, an outlet, and at least one structure which impedes circular flow of the fluid composition about the outlet.

In yet another aspect, a variable flow resistance system for use in a subterranean well is provided. The system can include a flow chamber through which a fluid composition flows in the well, the chamber having at least one inlet, an outlet, and at least one structure which impedes a change from circular flow of the fluid composition about the outlet to radial flow toward the outlet.

In another aspect, a variable flow resistance system described below can include a flow chamber with an outlet and at least one structure which resists a change in a direction of flow of a fluid composition toward the outlet. The fluid composition enters the chamber in a direction of flow which changes based on a ratio of desired fluid to undesired fluid in the fluid composition.

In yet another aspect, this disclosure provides a variable flow resistance system which can include a flow path selection device that selects which of multiple flow paths a majority of fluid flows through from the device, based on a ratio of desired fluid to undesired fluid in a fluid composition. The system also includes a flow chamber having an outlet, a first inlet connected to a first one of the flow paths, a second inlet connected to a second one of the flow paths, and at least one structure which impedes radial flow of the fluid composition from the second inlet to the outlet more than it impedes radial flow of the fluid composition from the first inlet to the outlet.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
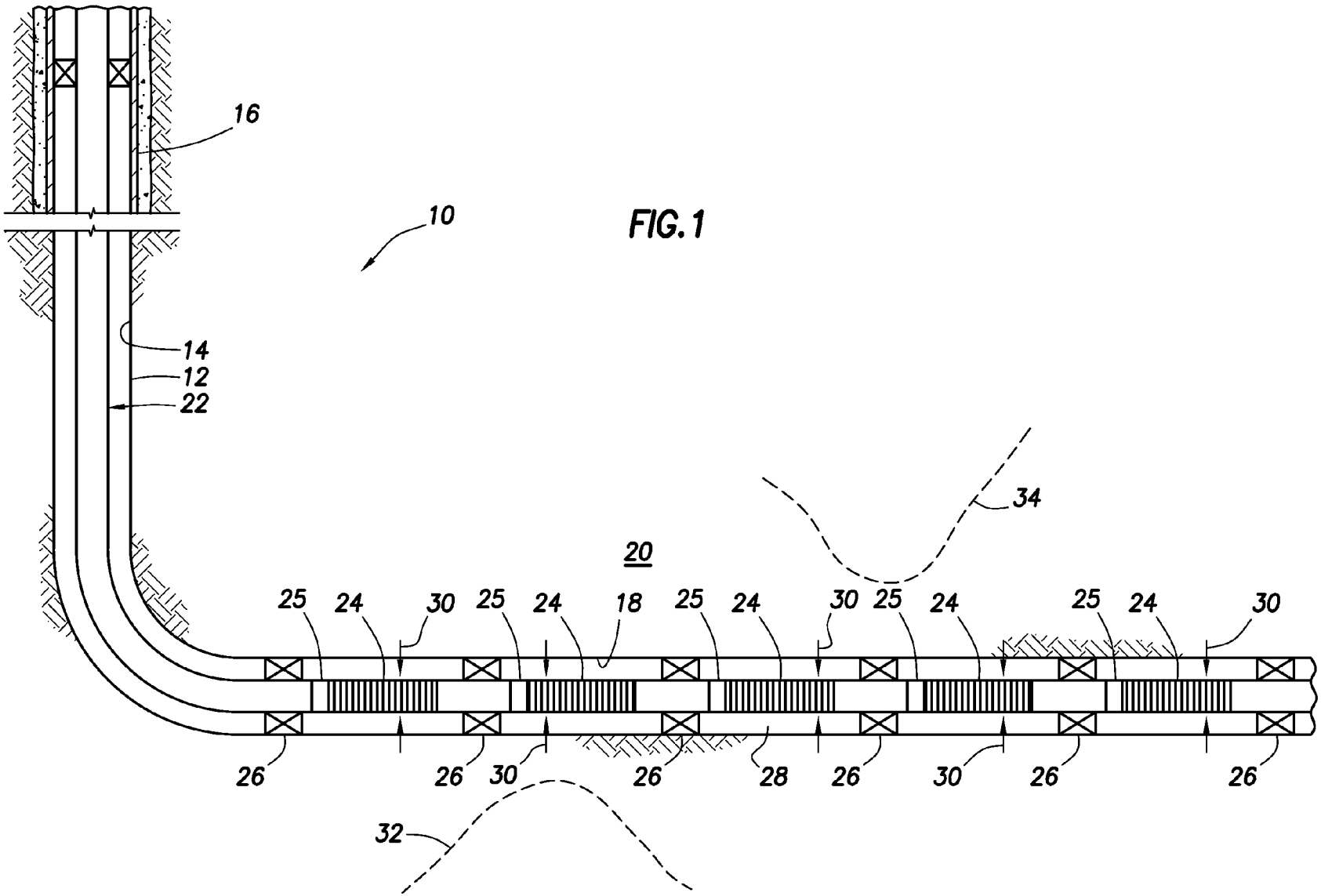
FIG. 1 is a schematic partially cross-sectional view of a well system which can embody principles of the present disclosure.

Representatively illustrated in FIG. 1 is a well system 10 which can embody principles of this disclosure. As depicted in FIG. 1, a wellbore 12 has a generally vertical uncased section 14 extending downwardly from casing 16, as well as a generally horizontal uncased section 18 extending through an earth formation 20.

A tubular string 22 (such as a production tubing string) is installed in the wellbore 12. Interconnected in the tubular string 22 are multiple well screens 24, variable flow resistance systems 25 and packers 26.

The packers 26 seal off an annulus 28 formed radially between the tubular string 22 and the wellbore section 18. In this manner, fluids 30 may be produced from multiple intervals or zones of the formation 20 via isolated portions of the annulus 28 between adjacent pairs of the packers 26.

Positioned between each adjacent pair of the packers 26, a well screen 24 and a variable flow resistance system 25 are interconnected in the tubular string 22. The well screen 24 filters the fluids 30 flowing into the tubular string 22 from the annulus 28. The variable flow resistance system 25 variably restricts flow of the fluids 30 into the tubular string 22, based on certain characteristics of the fluids.

At this point, it should be noted that the well system 10 is illustrated in the drawings and is described herein as merely one example of a wide variety of well systems in which the principles of this disclosure can be utilized. It should be clearly understood that the principles of this disclosure are not limited at all to any of the details of the well system 10, or components thereof, depicted in the drawings or described herein.

For example, it is not necessary in keeping with the principles of this disclosure for the wellbore 12 to include a generally vertical wellbore section 14 or a generally horizontal wellbore section 18. It is not necessary for fluids 30 to be only produced from the formation 20 since, in other examples, fluids could be injected into a formation, fluids could be both injected into and produced from a formation, etc.

It is not necessary for one each of the well screen 24 and variable flow resistance system 25 to be positioned between each adjacent pair of the packers 26. It is not necessary for a single variable flow resistance system 25 to be used in conjunction with a single well screen 24. Any number, arrangement and/or combination of these components may be used.

It is not necessary for any variable flow resistance system 25 to be used with a well screen 24. For example, in injection operations, the injected fluid could be flowed through a variable flow resistance system 25, without also flowing through a well screen 24.

It is not necessary for the well screens 24, variable flow resistance systems 25, packers 26 or any other components of the tubular string 22 to be positioned in uncased sections 14, 18 of the wellbore 12. Any section of the wellbore 12 may be cased or uncased, and any portion of the tubular string 22 may be positioned in an uncased or cased section of the wellbore, in keeping with the principles of this disclosure.

It should be clearly understood, therefore, that this disclosure describes how to make and use certain examples, but the principles of the disclosure are not limited to any details of those examples. Instead, those principles can be applied to a variety of other examples using the knowledge obtained from this disclosure.

It will be appreciated by those skilled in the art that it would be beneficial to be able to regulate flow of the fluids 30 into the tubular string 22 from each zone of the formation 20, for example, to prevent water coning 32 or gas coning 34 in the formation. Other uses for flow regulation in a well include, but are not limited to, balancing production from (or injection into) multiple zones, minimizing production or injection of undesired fluids, maximizing production or injection of desired fluids, etc.

Examples of the variable flow resistance systems 25 described more fully below can provide these benefits by increasing resistance to flow if a fluid velocity increases beyond a selected level (e.g., to thereby balance flow among zones, prevent water or gas coning, etc.), increasing resistance to flow if a fluid viscosity or density decreases below a selected level (e.g., to thereby restrict flow of an undesired fluid, such as water or gas, in an oil producing well), and/or increasing resistance to flow if a fluid viscosity or density increases above a selected level (e.g., to thereby minimize injection of water in a steam injection well).

Whether a fluid is a desired or an undesired fluid depends on the purpose of the production or injection operation being conducted. For example, if it is desired to produce oil from a well, but not to produce water or gas, then oil is a desired fluid and water and gas are undesired fluids. If it is desired to produce gas from a well, but not to produce water or oil, the gas is a desired fluid, and water and oil are undesired fluids. If it is desired to inject steam into a formation, but not to inject water, then steam is a desired fluid and water is an undesired fluid.

Note that, at downhole temperatures and pressures, hydrocarbon gas can actually be completely or partially in liquid phase. Thus, it should be understood that when the term "gas" is used herein, supercritical, liquid and/or gaseous phases are included within the scope of that term.

Figure 2:
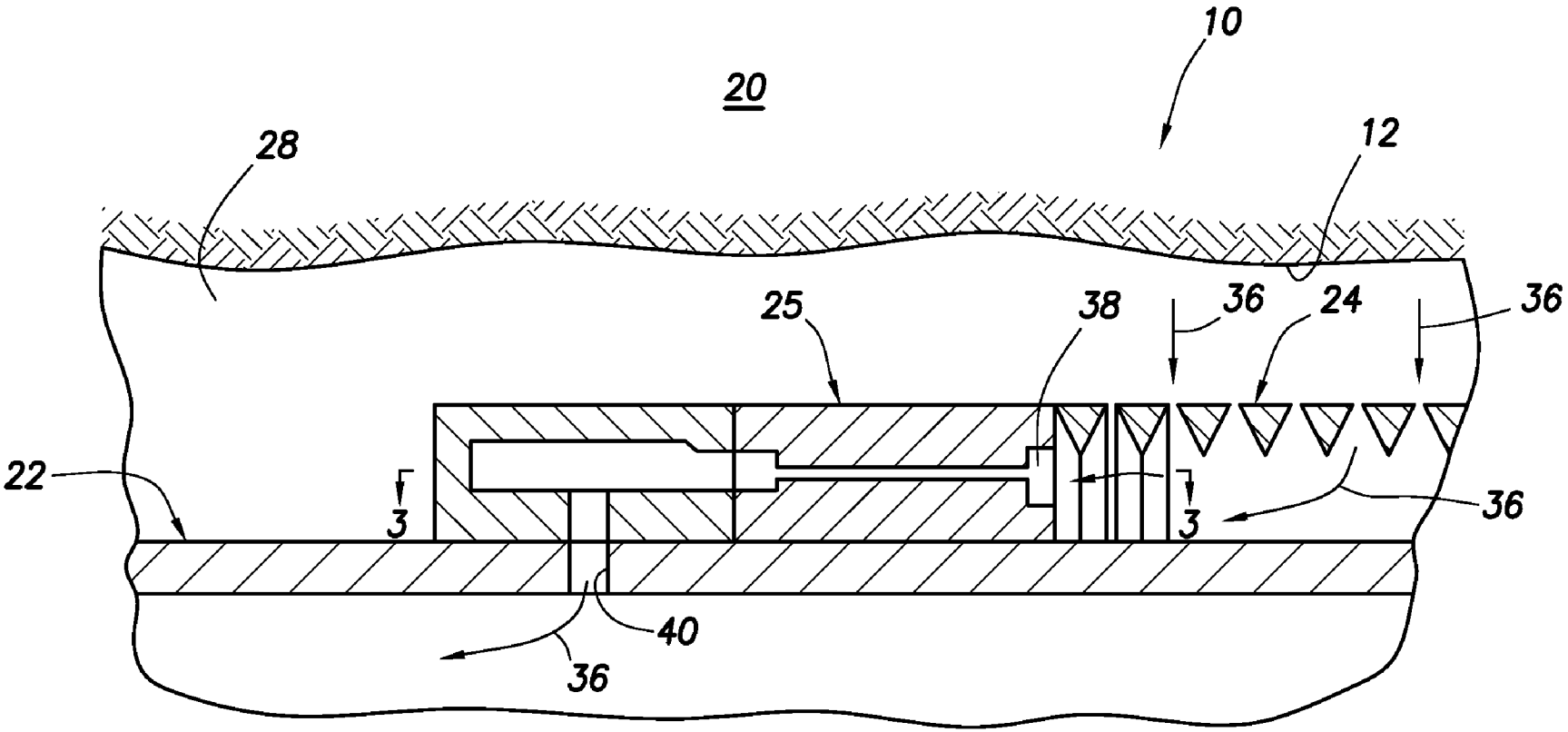
FIG. 2 is an enlarged scale schematic cross-sectional view of a well screen and a variable flow resistance system which may be used in the well system of FIG. 1.

Referring additionally now to FIG. 2, an enlarged scale cross-sectional view of one of the variable flow resistance systems 25 and a portion of one of the well screens 24 is representatively illustrated. In this example, a fluid composition 36 (which can include one or more fluids, such as oil and water, liquid water and steam, oil and gas, gas and water, oil, water and gas, etc.) flows into the well screen 24, is thereby filtered, and then flows into an inlet 38 of the variable flow resistance system 25.

A fluid composition can include one or more undesired or desired fluids. Both steam and water can be combined in a fluid composition. As another example, oil, water and/or gas can be combined in a fluid composition.

Flow of the fluid composition 36 through the variable flow resistance system 25 is resisted based on one or more characteristics (such as density, viscosity, velocity, etc.) of the fluid composition. The fluid composition 36 is then discharged from the variable flow resistance system 25 to an interior of the tubular string 22 via an outlet 40.

In other examples, the well screen 24 may not be used in conjunction with the variable flow resistance system 25 (e.g., in injection operations), the fluid composition 36 could flow in an opposite direction through the various elements of the well system 10 (e.g., in injection operations), a single variable flow resistance system could be used in conjunction with multiple well screens, multiple variable flow resistance systems could be used with one or more well screens, the fluid composition could be received from or discharged into regions of a well other than an annulus or a tubular string, the fluid composition could flow through the variable flow resistance system prior to flowing through the well screen, any other components could be interconnected upstream or downstream of the well screen and/or variable flow resistance system, etc. Thus, it will be appreciated that the principles of this disclosure are not limited at all to the details of the example depicted in FIG. 2 and described herein.

Although the well screen 24 depicted in FIG. 2 is of the type known to those skilled in the art as a wire-wrapped well screen, any other types or combinations of well screens (such as sintered, expanded, pre-packed, wire mesh, etc.) may be used in other examples. Additional components (such as shrouds, shunt tubes, lines, instrumentation, sensors, inflow control devices, etc.) may also be used, if desired.

The variable flow resistance system 25 is depicted in simplified form in FIG. 2, but in a preferred example, the system can include various passages and devices for performing various functions, as described more fully below. In addition, the system 25 preferably at least partially extends circumferentially about the tubular string 22, or the system may be formed in a wall of a tubular structure interconnected as part of the tubular string.

In other examples, the system 25 may not extend circumferentially about a tubular string or be formed in a wall of a tubular structure. For example, the system 25 could be formed in a flat structure, etc. The system 25 could be in a separate housing that is attached to the tubular string 22, or it could be oriented so that the axis of the outlet 40 is parallel to the axis of the tubular string. The system 25 could be on a logging string or attached to a device that is not tubular in shape. Any orientation or configuration of the system 25 may be used in keeping with the principles of this disclosure.

Figure 3:
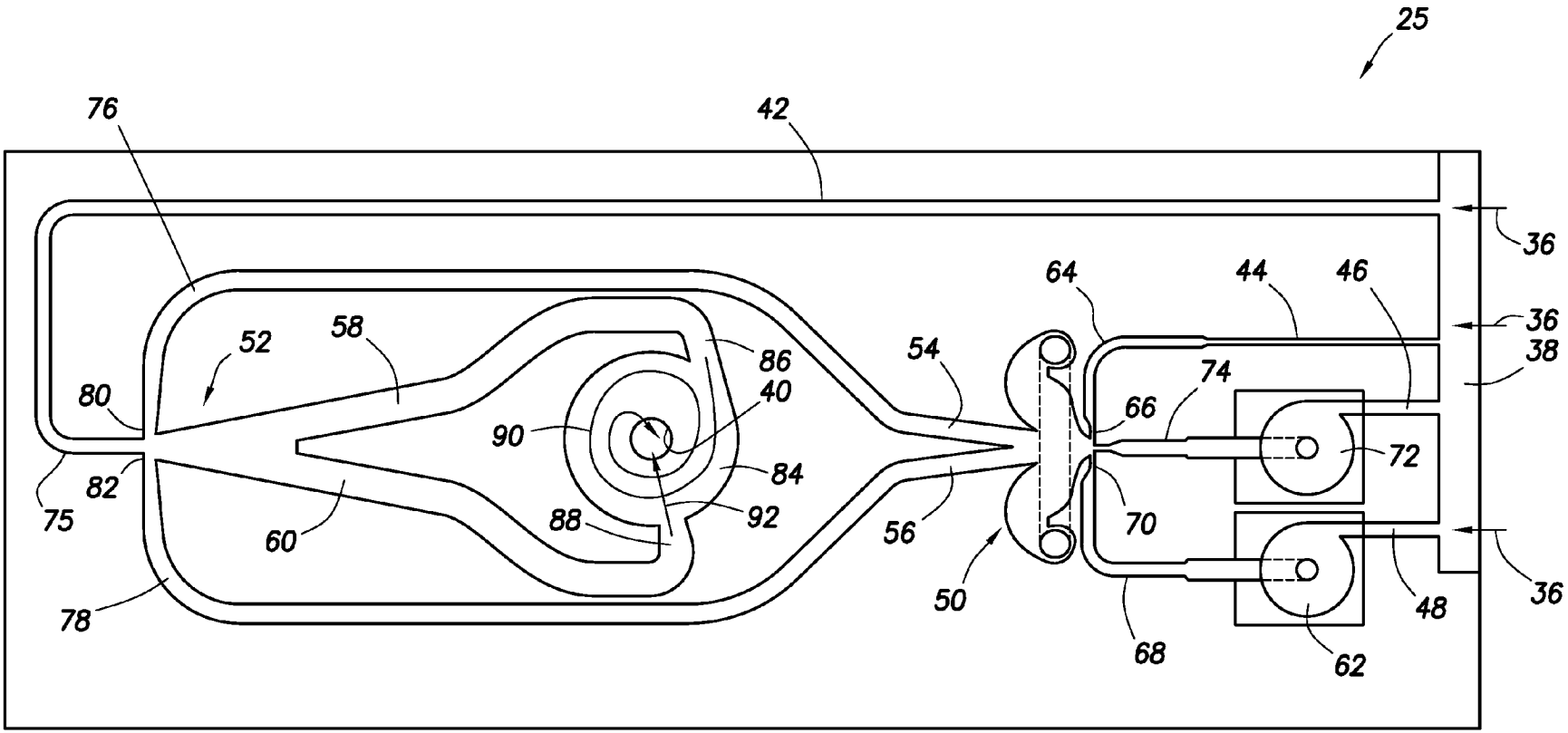
FIG. 3 is a schematic "unrolled" plan view of one configuration of the variable flow resistance system, taken along line 3-3 of FIG. 2.

Referring additionally now to FIG. 3, a more detailed cross-sectional view of one example of the system 25 is representatively illustrated. The system 25 is depicted in FIG. 3 as if it is "unrolled" from its circumferentially extending configuration to a generally planar configuration.

As described above, the fluid composition 36 enters the system 25 via the inlet 38, and exits the system via the outlet 40. A resistance to flow of the fluid composition 36 through the system 25 varies based on one or more characteristics of the fluid composition. The system 25 depicted in FIG. 3 is similar in most respects to that illustrated in FIG. 23 of the prior application Ser. No. 12/700,685 incorporated herein by reference above.

In the example of FIG. 3, the fluid composition 36 initially flows into multiple flow passages 42, 44, 46, 48. The flow passages 42, 44, 46, 48 direct the fluid composition 36 to two flow path selection devices 50, 52. The device 50 selects which of two flow paths 54, 56 a majority of the flow from the passages 44, 46, 48 will enter, and the other device 52 selects which of two flow paths 58, 60 a majority of the flow from the passages 42, 44, 46, 48 will enter.

The flow passage 44 is configured to be more restrictive to flow of fluids having higher viscosity. Flow of increased viscosity fluids will be increasingly restricted through the flow passage 44.

As used herein, the term "viscosity" is used to indicate any of the related rheological properties including kinematic viscosity, yield strength, viscoplasticity, surface tension, wettability, etc.

For example, the flow passage 44 may have a relatively small flow area, the flow passage may require the fluid flowing therethrough to follow a tortuous path, surface roughness or flow impeding structures may be used to provide an increased resistance to flow of higher viscosity fluid, etc. Relatively low viscosity fluid, however, can flow through the flow passage 44 with relatively low resistance to such flow.

A control passage 64 of the flow path selection device 50 receives the fluid which flows through the flow passage 44. A control port 66 at an end of the control passage 64 has a reduced flow area to thereby increase a velocity of the fluid exiting the control passage.

The flow passage 48 is configured to have a flow resistance which is relatively insensitive to viscosity of fluids flowing therethrough, but which may be increasingly resistant to flow of higher velocity and/or density fluids. Flow of increased viscosity fluids may be increasingly resisted through the flow passage 48, but not to as great an extent as flow of such fluids would be resisted through the flow passage 44.

In the example depicted in FIG. 3, fluid flowing through the flow passage 48 must flow through a "vortex" chamber 62 prior to being discharged into a control passage 68 of the flow path selection device 50. Since the chamber 62 in this example has a cylindrical shape with a central outlet, and the fluid composition 36 spirals about the chamber, increasing in velocity as it nears the outlet, driven by a pressure differential from the inlet to the outlet, the chamber is referred to as a "vortex" chamber. In other examples, one or more orifices, venturis, nozzles, etc. may be used.

The control passage 68 terminates at a control port 70. The control port 70 has a reduced flow area, in order to increase the velocity of the fluid exiting the control passage 68.

It will be appreciated that, as a viscosity of the fluid composition 36 increases, a greater proportion of the fluid composition will flow through the flow passage 48, control passage 68 and control port 70 (due to the flow passage 44 resisting flow of higher viscosity fluid more than the flow passage 48 and vortex chamber 62), and as a viscosity of the fluid composition decreases, a greater proportion of the fluid composition will flow through the flow passage 44, control passage 64 and control port 66.

Fluid which flows through the flow passage 46 also flows through a vortex chamber 72, which may be similar to the vortex chamber 62 (although the vortex chamber 72 in a preferred example provides less resistance to flow therethrough than the vortex chamber 62), and is discharged into a central passage 74. The vortex chamber 72 is used for "impedance matching" to achieve a desired balance of flows through the flow passages 44, 46, 48.

Note that dimensions and other characteristics of the various components of the system 25 will need to be selected appropriately, so that desired outcomes are achieved. In the example of FIG. 3, one desired outcome of the flow path selection device 50 is that flow of a majority of the fluid composition 36 which flows through the flow passages 44, 46, 48 is directed into the flow path 54 when the fluid composition has a sufficiently high ratio of desired fluid to undesired fluid therein.

In this case, the desired fluid is oil, which has a higher viscosity than water or gas, and so when a sufficiently high proportion of the fluid composition 36 is oil, a majority of the fluid composition 36 which enters the flow path selection device 50 will be directed to flow into the flow path 54, instead of into the flow path 56. This result is achieved due to the fluid exiting the control port 70 at a greater rate or at a higher velocity than fluid exiting the other control port 66, thereby influencing the fluid flowing from the passages 64, 68, 74 to flow more toward the flow path 54.

If the viscosity of the fluid composition 36 is not sufficiently high (and thus a ratio of desired fluid to undesired fluid is below a selected level), a majority of the fluid composition which enters the flow path selection device 50 will be directed to flow into the flow path 56, instead of into the flow path 54. This will be due to the fluid exiting the control port 66 at a greater rate or at a higher velocity than fluid exiting the other control port 70, thereby influencing the fluid flowing from the passages 64, 68, 74 to flow more toward the flow path 56.

It will be appreciated that, by appropriately configuring the flow passages 44, 46, 48, control passages 64, 68, control ports 66, 70, vortex chambers 62, 72, etc., the ratio of desired to undesired fluid in the fluid composition 36 at which the device 50 selects either the flow passage 54 or 56 for flow of a majority of fluid from the device can be set to various different levels.

The flow paths 54, 56 direct fluid to respective control passages 76, 78 of the other flow path selection device 52. The control passages 76, 78 terminate at respective control ports 80, 82. A central passage 75 receives fluid from the flow passage 42.

The flow path selection device 52 operates similar to the flow path selection device 50, in that fluid which flows into the device 52 via the passages 75, 76, 78 is directed toward one of the flow paths 58, 60, and the flow path selection depends on a ratio of fluid discharged from the control ports 80, 82. If fluid flows through the control port 80 at a greater rate or velocity as compared to fluid flowing through the control port 82, then a majority of the fluid composition 36 will be directed to flow through the flow path 60. If fluid flows through the control port 82 at a greater rate or velocity as compared to fluid flowing through the control port 80, then a majority of the fluid composition 36 will be directed to flow through the flow path 58.

Although two of the flow path selection devices 50, 52 are depicted in the example of the system 25 in FIG. 3, it will be appreciated that any number (including one) of flow path selection devices may be used in keeping with the principles of this disclosure. The devices 50, 52 illustrated in FIG. 3 are of the type known to those skilled in the art as jet-type fluid ratio amplifiers, but other types of flow path selection devices (e.g., pressure-type fluid ratio amplifiers, bi-stable fluid switches, proportional fluid ratio amplifiers, etc.) may be used in keeping with the principles of this disclosure.

Fluid which flows through the flow path 58 enters a flow chamber 84 via an inlet 86 which directs the fluid to enter the chamber generally tangentially (e.g., the chamber 84 is shaped similar to a cylinder, and the inlet 86 is aligned with a tangent to a circumference of the cylinder). As a result, the fluid will spiral about the chamber 84, until it eventually exits via the outlet 40, as indicated schematically by arrow 90 in FIG. 3.

Fluid which flows through the flow path 60 enters the flow chamber 84 via an inlet 88 which directs the fluid to flow more directly toward the outlet 40 (e.g., in a radial direction, as indicated schematically by arrow 92 in FIG. 3). As will be readily appreciated, much less energy is consumed at the same flow rate when the fluid flows more directly toward the outlet 40 as compared to when the fluid flows less directly toward the outlet.

Thus, less resistance to flow is experienced when the fluid composition 36 flows more directly toward the outlet 40 and, conversely, more resistance to flow is experienced when the fluid composition flows less directly toward the outlet. Accordingly, working upstream from the outlet 40, less resistance to flow is experienced when a majority of the fluid composition 36 flows into the chamber 84 from the inlet 88, and through the flow path 60.

A majority of the fluid composition 36 flows through the flow path 60 when fluid exits the control port 80 at a greater rate or velocity as compared to fluid exiting the control port 82. More fluid exits the control port 80 when a majority of the fluid flowing from the passages 64, 68, 74 flows through the flow path 54.

A majority of the fluid flowing from the passages 64, 68, 74 flows through the flow path 54 when fluid exits the control port 70 at a greater rate or velocity as compared to fluid exiting the control port 66. More fluid exits the control port 70 when a viscosity of the fluid composition 36 is above a selected level.

Thus, flow through the system 25 is resisted less when the fluid composition 36 has an increased viscosity (and a greater ratio of desired to undesired fluid therein). Flow through the system 25 is resisted more when the fluid composition 36 has a decreased viscosity.

More resistance to flow is experienced when the fluid composition 36 flows less directly toward the outlet 40 (e.g., as indicated by arrow 90). Thus, more resistance to flow is experienced when a majority of the fluid composition 36 flows into the chamber 84 from the inlet 86, and through the flow path 58.

A majority of the fluid composition 36 flows through the flow path 58 when fluid exits the control port 82 at a greater rate or velocity as compared to fluid exiting the control port 80. More fluid exits the control port 82 when a majority of the fluid flowing from the passages 64, 68, 74 flows through the flow path 56, instead of through the flow path 54.

A majority of the fluid flowing from the passages 64, 68, 74 flows through the flow path 56 when fluid exits the control port 66 at a greater rate or velocity as compared to fluid exiting the control port 70. More fluid exits the control port 66 when a viscosity of the fluid composition 36 is below a selected level.

As described above, the system 25 is configured to provide less resistance to flow when the fluid composition 36 has an increased viscosity, and more resistance to flow when the fluid composition has a decreased viscosity. This is beneficial when it is desired to flow more of a higher viscosity fluid, and less of a lower viscosity fluid (e.g., in order to produce more oil and less water or gas).

If it is desired to flow more of a lower viscosity fluid, and less of a higher viscosity fluid (e.g., in order to produce more gas and less water, or to inject more steam and less water), then the system 25 may be readily reconfigured for this purpose. For example, the inlets 86, 88 could conveniently be reversed, so that fluid which flows through the flow path 58 is directed to the inlet 88, and fluid which flows through the flow path 60 is directed to the inlet 86.

Figure 4B:
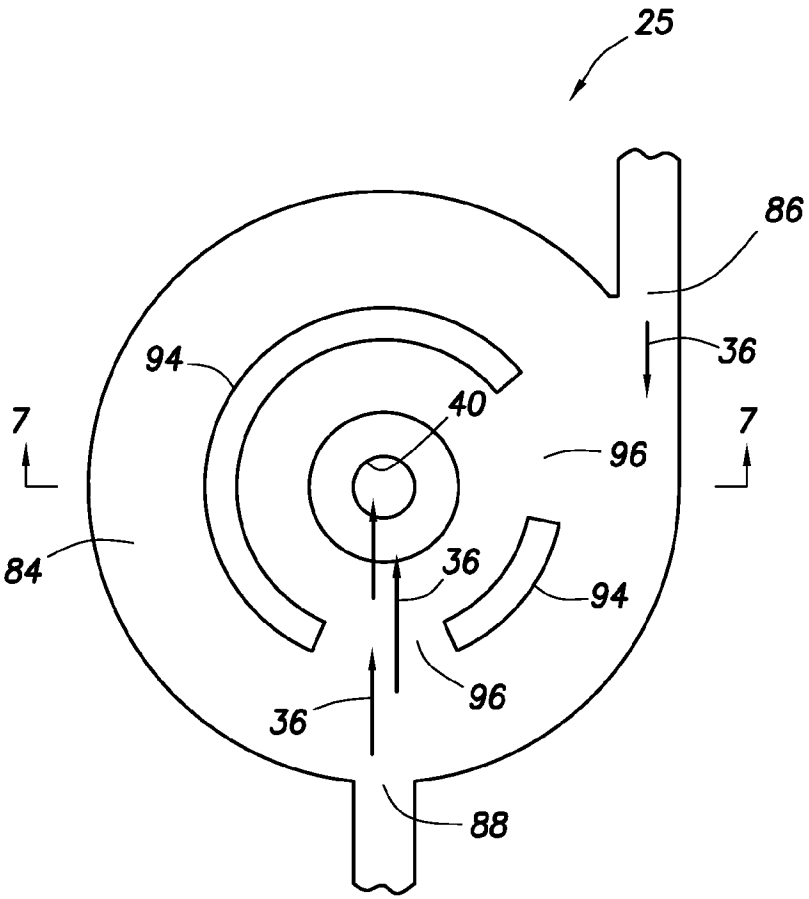
FIGS. 4A & B are schematic plan views of another configuration of a flow chamber of the variable flow resistance system.
Figure 4A:
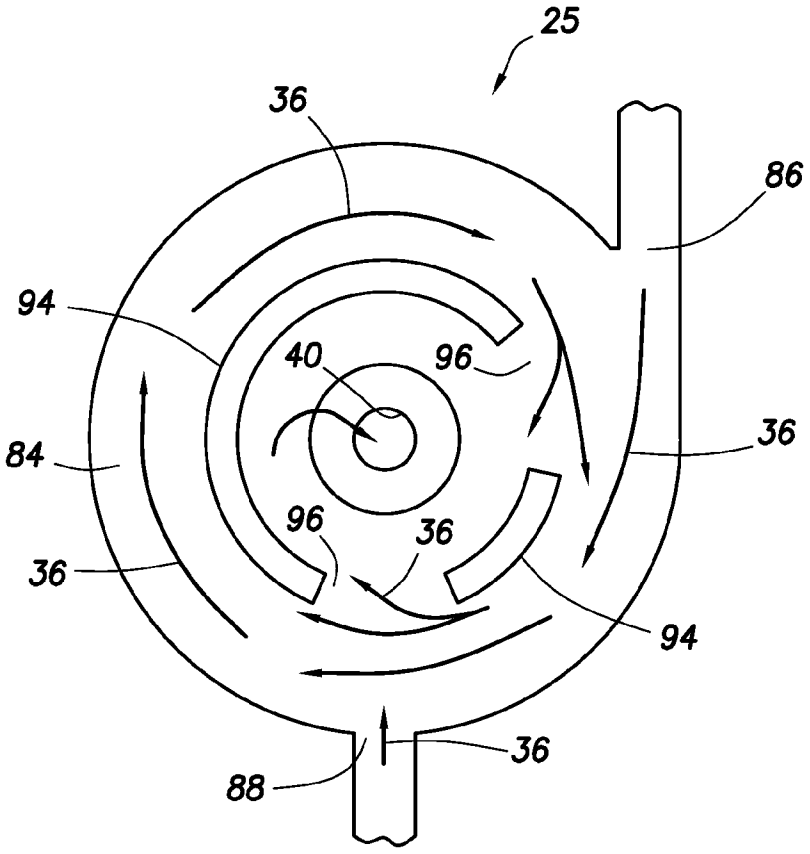

Referring additionally now to FIGS. 4A & B, another configuration of the flow chamber 84 is representatively illustrated, apart from the remainder of the variable flow resistance system 25. The flow chamber 84 of FIGS. 4A & B is similar in most respects to the flow chamber of FIG. 3, but differs at least in that one or more structures 94 are included in the chamber. As depicted in FIGS. 4A & B, the structure 94 may be considered as a single structure having one or more breaks or openings 96 therein, or as multiple structures separated by the breaks or openings.

The structure 94 induces any portion of the fluid composition 36 which flows circularly about the chamber 84, and has a relatively high velocity, high density or low viscosity, to continue to flow circularly about the chamber, but at least one of the openings 96 permits more direct flow of the fluid composition from the inlet 88 to the outlet 40. Thus, when the fluid composition 36 enters the other inlet 86, it initially flows circularly in the chamber 84 about the outlet 40, and the structure 94 increasingly resists or impedes a change in direction of the flow of the fluid composition toward the outlet, as the velocity and/or density of the fluid composition increases, and/or as a viscosity of the fluid composition decreases. The openings 96, however, permit the fluid composition 36 to gradually flow spirally inward to the outlet 40.

In FIG. 4A, a relatively high velocity, low viscosity and/or high density fluid composition 36 enters the chamber 84 via the inlet 86. Some of the fluid composition 36 may also enter the chamber 84 via the inlet 88, but in this example, a substantial majority of the fluid composition enters via the inlet 86, thereby flowing tangential to the flow chamber 84 initially (i.e., at an angle of 0 degrees relative to a tangent to the outer circumference of the flow chamber).

Upon entering the chamber 84, the fluid composition 36 initially flows circularly about the outlet 40. For most of its path about the outlet 40, the fluid composition 36 is prevented, or at least impeded, from changing direction and flowing radially toward the outlet by the structure 94. The openings 96 do, however, gradually allow portions of the fluid composition 36 to spiral radially inward toward the outlet 40.

In FIG. 4B, a relatively low velocity, high viscosity and/or low density fluid composition 36 enters the chamber 84 via the inlet 88. Some of the fluid composition 36 may also enter the chamber 84 via the inlet 86, but in this example, a substantial majority of the fluid composition enters via the inlet 88, thereby flowing radially through the flow chamber 84 (i.e., at an angle of 90 degrees relative to a tangent to the outer circumference of the flow chamber).

One of the openings 96 allows the fluid composition 36 to flow more directly from the inlet 88 to the outlet 40. Thus, radial flow of the fluid composition 36 toward the outlet 40 in this example is not resisted or impeded significantly by the structure 94.

If a portion of the relatively low velocity, high viscosity and/or low density fluid composition 36 should flow circularly about the outlet 40 in FIG. 4B, the openings 96 will allow the fluid composition to readily change direction and flow more directly toward the outlet. Indeed, as a viscosity of the fluid composition 36 increases, or as a density or velocity of the fluid composition decreases, the structures 94 in this situation will increasingly impede the circular flow of the fluid composition 36 about the chamber 84, enabling the fluid composition to more readily change direction and flow through the openings 96.

Note that it is not necessary for multiple openings 96 to be provided in the structure 94, since the fluid composition 36 could flow more directly from the inlet 88 to the outlet 40 via a single opening, and a single opening could also allow flow from the inlet 86 to gradually spiral inwardly toward the outlet. Any number of openings 96 (or other areas of low resistance to radial flow) could be provided in keeping with the principles of this disclosure.

Furthermore, it is not necessary for one of the openings 96 to be positioned directly between the inlet 88 and the outlet 40. The openings 96 in the structure 94 can provide for more direct flow of the fluid composition 36 from the inlet 88 to the outlet 40, even if some circular flow of the fluid composition about the structure is needed for the fluid composition to flow inward through one of the openings.

It will be appreciated that the more circuitous flow of the fluid composition 36 in the FIG. 4A example results in more energy being consumed at the same flow rate and, therefore, more resistance to flow of the fluid composition as compared to the example of FIG. 4B. If oil is a desired fluid, and water and/or gas are undesired fluids, then it will be appreciated that the variable flow resistance system 25 of FIGS. 4A & B will provide less resistance to flow of the fluid composition 36 when it has an increased ratio of desired to undesired fluid therein, and will provide greater resistance to flow when the fluid composition has a decreased ratio of desired to undesired fluid therein.

Figure 5:
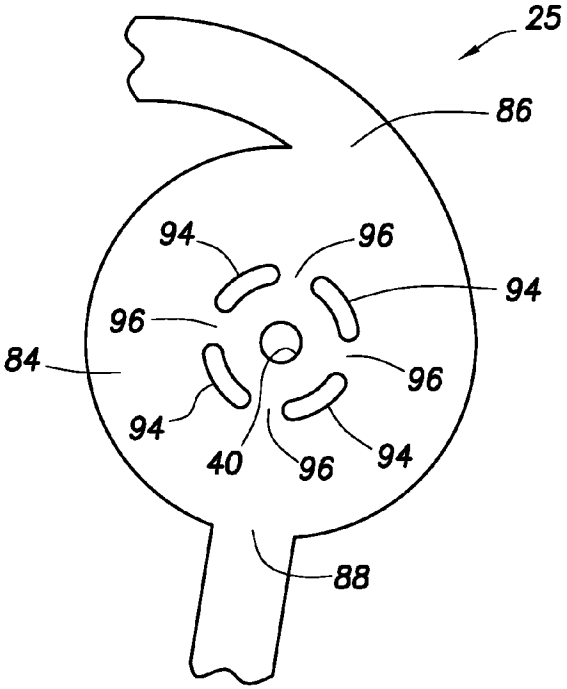
FIG. 5 is a schematic plan view of yet another configuration of the flow chamber.

Referring additionally now to FIG. 5, another configuration of the chamber 84 is representatively illustrated. In this configuration, the chamber 84 includes four of the structures 94, which are equally spaced apart by four openings 96. The structures 94 may be equally or unequally spaced apart, depending on the desired operational parameters of the system 25.

Figure 6B:
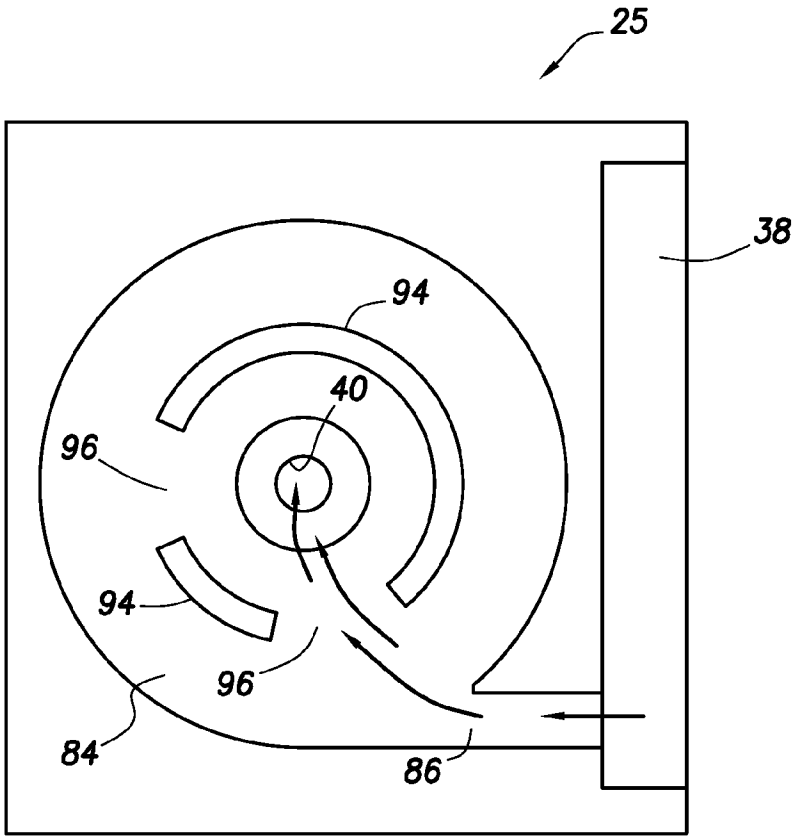
FIGS. 6A & B are schematic plan views of yet another configuration of the variable flow resistance system.
Figure 6A:
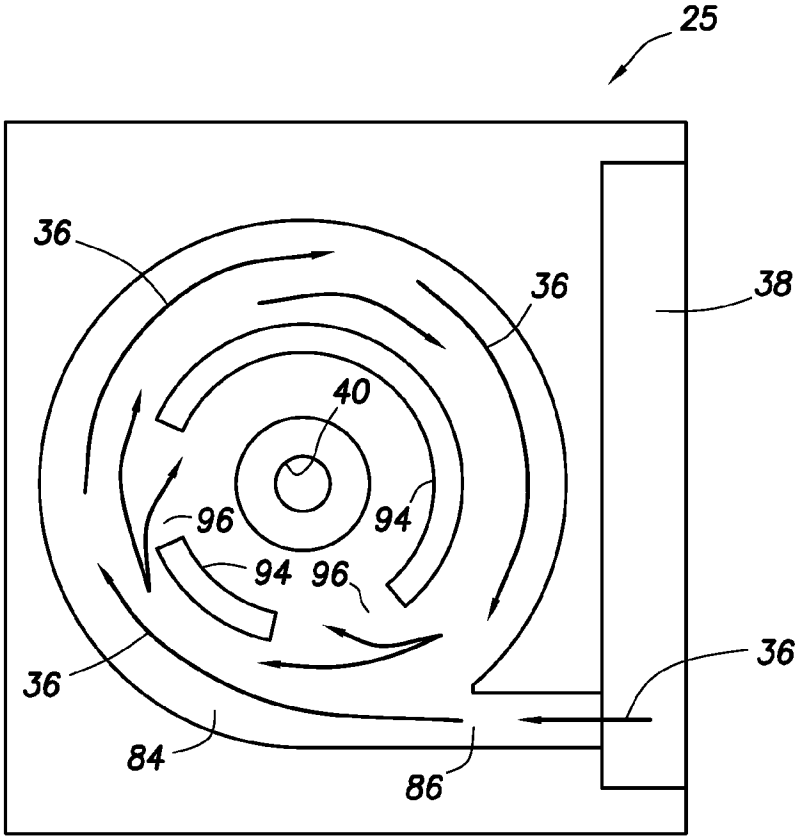

Referring additionally now to FIGS. 6A & B, another configuration of the variable flow resistance system 25 is representatively illustrated. The variable flow resistance system 25 of FIGS. 6A & B differs substantially from that of FIG. 3, at least in that it is much less complex and has many fewer components. Indeed, in the configuration of FIGS. 6A & B, only the chamber 84 is interposed between the inlet 38 and the outlet 40 of the system 25.

The chamber 84 in the configuration of FIGS. 6A & B has only a single inlet 86. The chamber 84 also includes the structures 94 therein.

In FIG. 6A, a relatively high velocity, low viscosity and/or high density fluid composition 36 enters the chamber 84 via the inlet 86 and is influenced by the structure 94 to continue to flow about the chamber. The fluid composition 36, thus, flows circuitously through the chamber 84, eventually spiraling inward to the outlet 40 as it gradually bypasses the structure 94 via the openings 96.

In FIG. 6B, however, the fluid composition 36 has a lower velocity, increased viscosity and/or decreased density. The fluid composition 36 in this example is able to change direction more readily as it flows into the chamber 84 via the inlet 86, allowing it to flow more directly from the inlet to the outlet 40 via the openings 96.

It will be appreciated that the much more circuitous flow path taken by the fluid composition 36 in the example of FIG. 6A consumes more of the fluid composition's energy at the same flow rate and, thus, results in more resistance to flow, as compared to the much more direct flow path taken by the fluid composition in the example of FIG. 6B. If oil is a desired fluid, and water and/or gas are undesired fluids, then it will be appreciated that the variable flow resistance system 25 of FIGS. 6A & B will provide less resistance to flow of the fluid composition 36 when it has an increased ratio of desired to undesired fluid therein, and will provide greater resistance to flow when the fluid composition has a decreased ratio of desired to undesired fluid therein.

Although in the configuration of FIGS. 6A & B, only a single inlet 86 is used for admitting the fluid composition 36 into the chamber 84, in other examples multiple inlets could be provided, if desired. The fluid composition 36 could flow into the chamber 84 via multiple inlets simultaneously or separately. For example, different inlets could be used for when the fluid composition 36 has corresponding different characteristics (such as different velocities, viscosities, densities, etc.).

The structure 94 may be in the form of one or more circumferentially extending vanes having one or more of the openings 96 between the vane(s). Alternatively, or in addition, the structure 94 could be in the form of one or more circumferentially extending recesses in one or more walls of the chamber 84. The structure 94 could project inwardly and/or outwardly relative to one or more walls of the chamber 84. Thus, it will be appreciated that any type of structure which functions to increasingly influence the fluid composition 36 to continue to flow circuitously about the chamber 84 as the velocity or density of the fluid composition increases, or as a viscosity of the fluid decreases, and/or which functions to increasingly impede circular flow of the fluid composition about the chamber as the velocity or density of the fluid composition decreases, or as a viscosity of the fluid increases, may be used in keeping with the principles of this disclosure.

Several illustrative schematic examples of the structure 94 are depicted in FIGS. 7A-J, with the cross-sectional views of FIGS. 7A-G being taken along line 7-7 of FIG. 4B. These various examples demonstrate that a great variety of possibilities exist for constructing the structure 94, and so it should be appreciated that the principles of this disclosure are not limited to use of any particular structure configuration in the chamber 84.

Figure 7C:
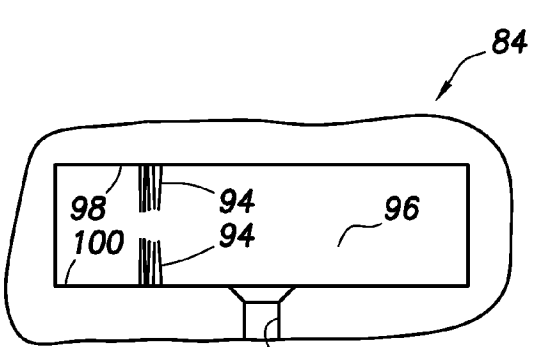
FIGS. 7A-H are schematic cross-sectional views of various configurations of the flow chamber, with FIGS. 7A-G being taken along line 7-7 of FIG. 4B, and FIG. 7H being taken along line 7H-7H of FIG. 7G.
Figure 7B:
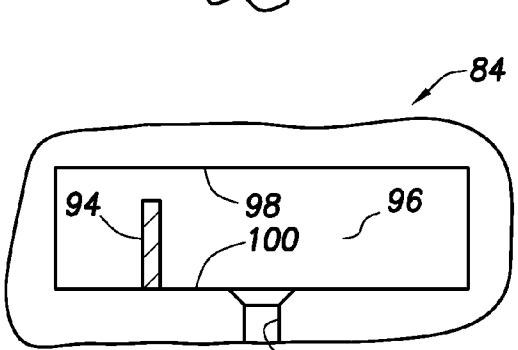
Figure 7A:
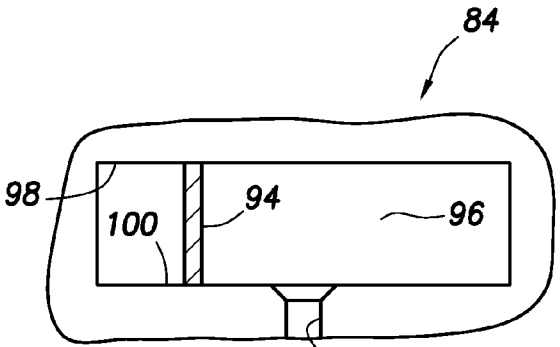

In FIG. 7A, the structure 94 comprises a wall or vane which extends between upper and lower (as viewed in the drawings)

walls 98, 100 of the chamber 84. The structure 94 in this example precludes radially inward flow of the fluid composition 36 from an outer portion of the chamber 84, except at the opening 96.

In FIG. 7B, the structure 94 comprises a wall or vane which extends only partially between the walls 98, 100 of the chamber 84. The structure 94 in this example does not preclude radially inward flow of the fluid composition 36, but does resist a change in direction from circular to radial flow in the outer portion of the chamber 84.

One inlet (such as inlet 88) could be positioned at a height relative to the chamber walls 98, 100 so that the fluid composition 36 entering the chamber 84 via that inlet does not impinge substantially on the structure 94 (e.g., flowing over or under the structure). Another inlet (such as the inlet 86) could be positioned at a different height, so that the fluid composition 36 entering the chamber 84 via that inlet does impinge substantially on the structure 94. More resistance to flow would be experienced by the fluid composition 36 impinging on the structure.

In FIG. 7C, the structure 94 comprises whiskers, bristles or stiff wires which resist radially inward flow of the fluid composition 36 from the outer portion of the chamber 84. The structure 94 in this example may extend completely or partially between the walls 98, 100 of the chamber 84, and may extend inwardly from both walls.

In FIG. 7D, the structure 94 comprises multiple circumferentially extending recesses and projections which resist radially inward flow of the fluid composition 36. Either or both of the recesses and projections may be provided in the chamber 84. If only the recesses are provided, then the structure 94 may not protrude into the chamber 84 at all.

In FIG. 7E, the structure 94 comprises multiple circumferentially extending undulations formed on the walls 98, 100 of the chamber 84. Similar to the configuration of FIG. 7D, the undulations include recesses and projections, but in other examples either or both of the recesses and projections may be provided. If only the recesses are provided, then the structure 94 may not protrude into the chamber 84 at all.

In FIG. 7F, the structure 94 comprises circumferentially extending but radially offset walls or vanes extending inwardly from the walls 98, 100 of the chamber 84. Any number, arrangement and/or configuration of the walls or vanes may be used, in keeping with the principles of this disclosure.

In FIGS. 7G & H, the structure 94 comprises a wall or vane extending inwardly from the chamber wall 100, with another vane 102 which influences the fluid composition 36 to change direction axially relative to the outlet 40. For example, the vane 102 could be configured so that it directs the fluid composition 36 to flow axially away from, or toward, the outlet 40.

The vane 102 could be configured so that it accomplishes mixing of the fluid composition 36 received from multiple inlets, increases resistance to flow of fluid circularly in the chamber 84, and/or provides resistance to flow of fluid at different axial levels of the chamber, etc. Any number, arrangement, configuration, etc. of the vane 102 may be used, in keeping with the principles of this disclosure.

The vane 102 can provide greater resistance to circular flow of increased viscosity fluids, so that such fluids are more readily diverted toward the outlet 40. Thus, while the structure 94 increasingly impedes a fluid composition 36 having increased velocity, increased density or reduced viscosity from flowing radially inward toward the outlet 40, the vane 102 can increasingly resist circular flow of an increased viscosity fluid composition.

One inlet (such as inlet 88) could be positioned at a height relative to the chamber walls 98, 100 so that the fluid composition 36 entering the chamber 84 via that inlet does not impinge substantially on the structure 94 (e.g., flowing over or under the structure). Another inlet (such as the inlet 86) could be positioned at a different height, so that the fluid composition 36 entering the chamber 84 via that inlet does impinge substantially on the structure 94.

Figure 7J:
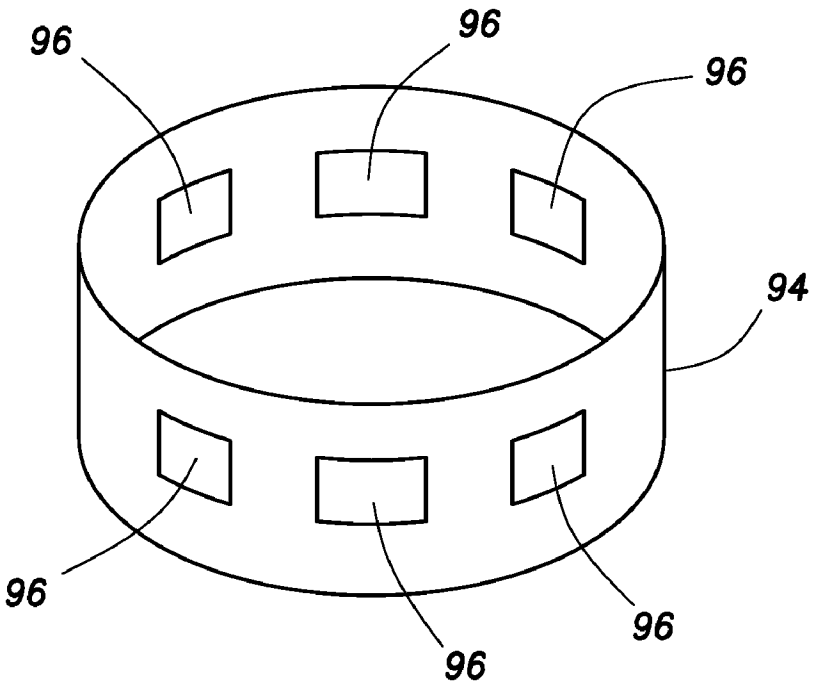
FIGS. 7I & J are schematic perspective views of configurations of structures which may be used in the flow chamber of the variable flow resistance system.
Figure 7I:
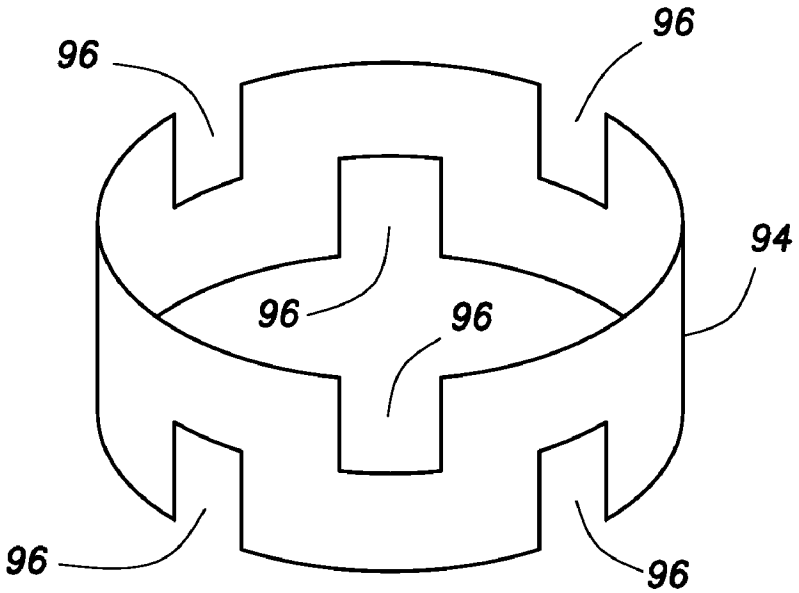

In FIG. 7I, the structure 94 comprises a one-piece cylindrical-shaped wall with the openings 96 being distributed about the wall, at alternating upper and lower ends of the wall. The structure 94 would be positioned between the end walls 98, 100 of the chamber 84.

In FIG. 7J, the structure 94 comprises a one-piece cylindrical-shaped wall, similar to that depicted in FIG. 7I, except that the openings 96 are distributed about the wall midway between its upper and lower ends.

Additional configurations of the flow chamber 84 and structures 94 therein are representatively illustrated in FIGS. 8A-11. These additional configurations demonstrate that a wide variety of different configurations are possible without departing from the principles of this disclosure, and those principles are not limited at all to the specific examples described herein and depicted in the drawings.

Figure 8B:
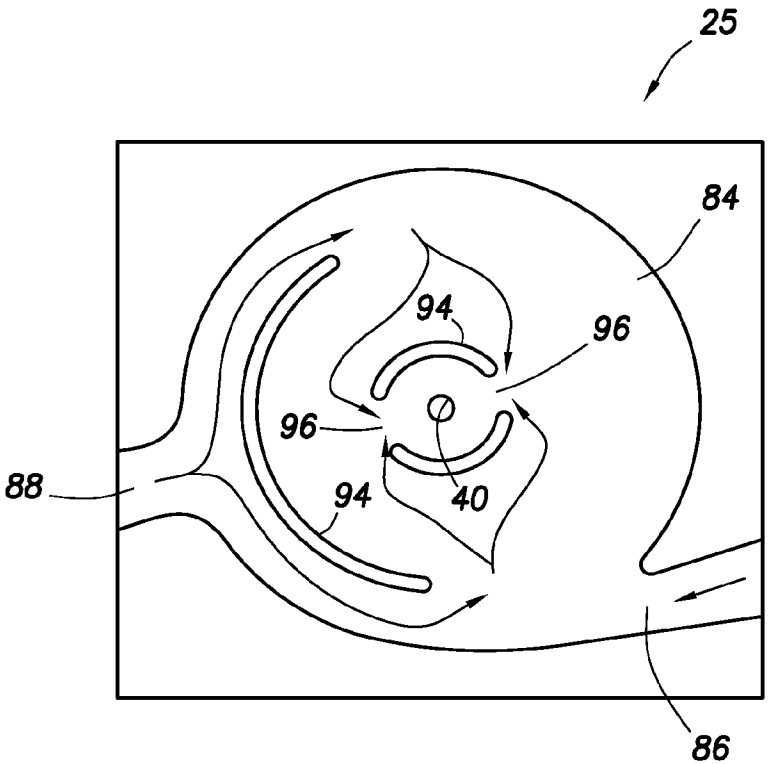
FIGS. 8A-11 are schematic plan views of additional configurations of the flow chamber.
Figure 8A:
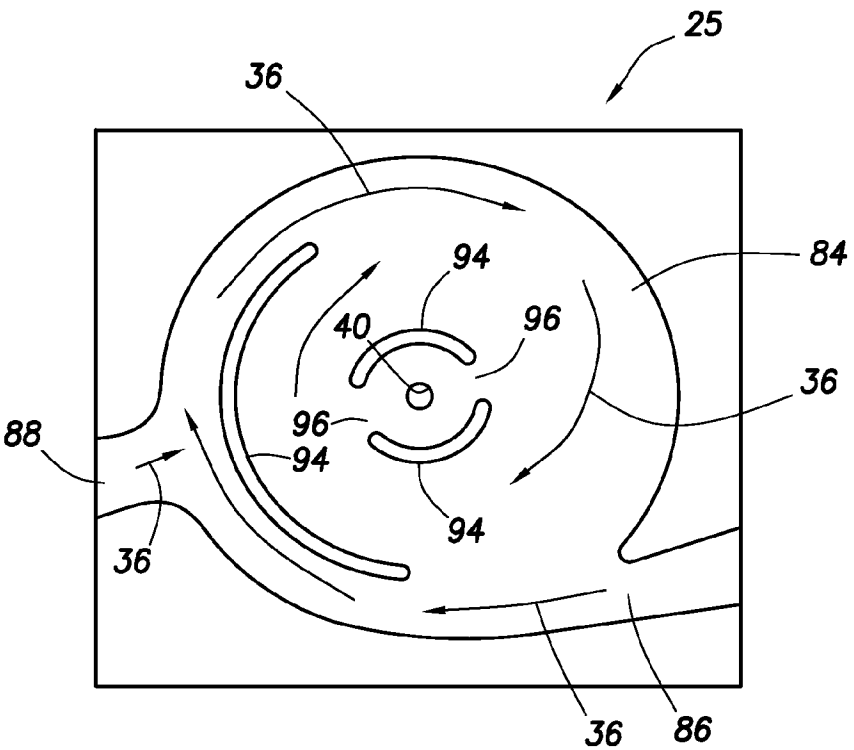

In FIG. 8A, the chamber 84 is similar in most respects to that of FIGS. 4A-5, with two inlets 86, 88. A majority of the fluid composition 36 having a relatively high velocity, low viscosity and/or high density flows into the chamber 84 via the inlet 86 and flows circularly about the outlet 40. The structures 94 impede radially inward flow of the fluid composition 36 toward the outlet 40.

In FIG. 8B, a majority of the fluid composition 36 having a relatively low velocity, high viscosity and/or low density flows into the chamber 84 via the inlet 88. One of the structures 94 prevents direct flow of the fluid composition 36 from the inlet 88 to the outlet 40, but the fluid composition can readily change direction to flow around each of the structures. Thus, a flow resistance of the system 25 of FIG. 8B is less than that of FIG. 8A.

Figure 9B:
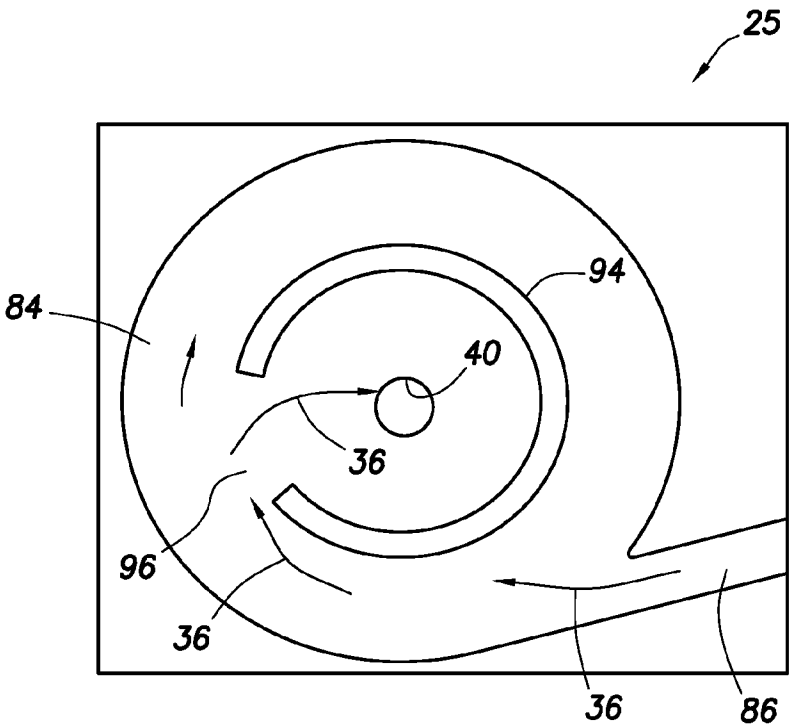
Figure 9A:
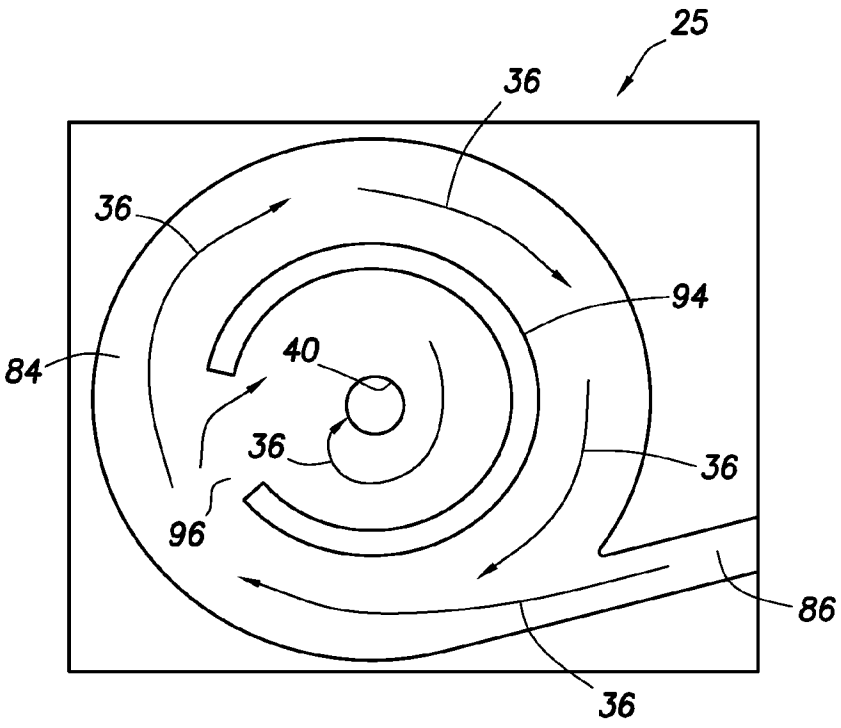

In FIG. 9A, the chamber 84 is similar in most respects to that of FIGS. 6A & B, with a single inlet 86. The fluid composition 36 having a relatively high velocity, low viscosity and/or high density flows into the chamber 84 via the inlet 86 and flows circularly about the outlet 40. The structure 94 impedes radially inward flow of the fluid composition 36 toward the outlet 40.

In FIG. 9B, the fluid composition 36 having a relatively low velocity, high viscosity and/or low density flows into the chamber 84 via the inlet 86. The structure 94 prevents direct flow of the fluid composition 36 from the inlet 88 to the outlet 40, but the fluid composition can readily change direction to flow around the structure and through the opening 96 toward the outlet. Thus, a flow resistance of the system 25 of FIG. 9B is less than that of FIG. 9A.

It is postulated that, by preventing flow of the relatively low velocity, high viscosity and/or low density fluid composition 36 directly to the outlet 40 from the inlet 88 in FIG. 8B, or from the inlet 86 in FIG. 9B, the radial velocity of the fluid composition toward the outlet can be desirably decreased, without significantly increasing the flow resistance of the system 25.

Figure 11:
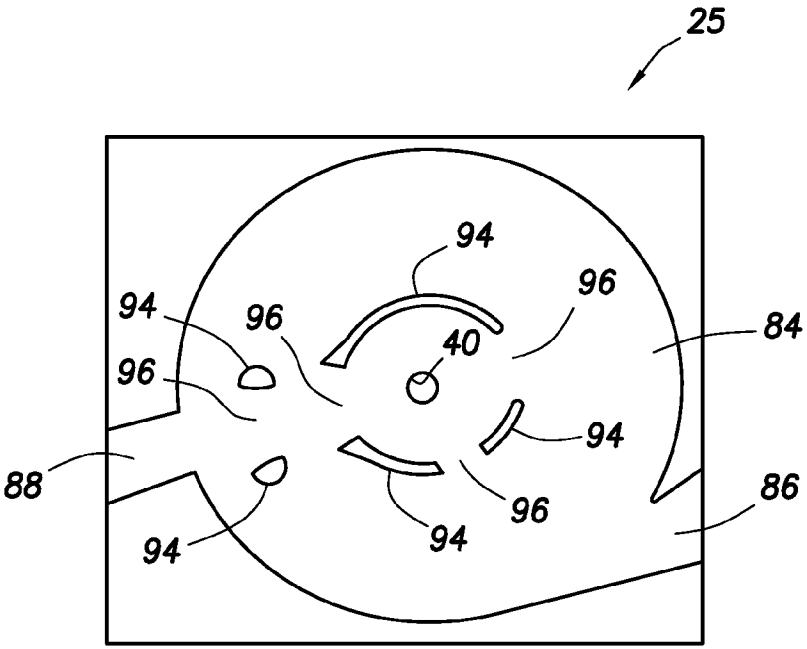
Figure 10:
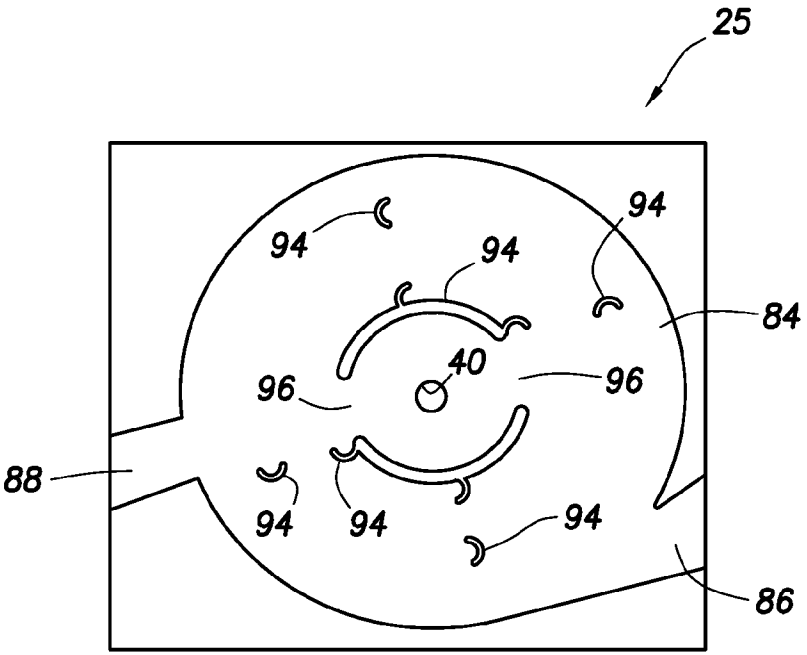

In FIGS. 10 & 11, the chamber 84 is similar in most respects to the configuration of FIGS. 4A-5, with two inlets 86, 88. Fluid composition 36 which flows into the chamber 84 via the inlet 86 will, at least initially, flow circularly about the outlet 40, whereas fluid composition which flows into the chamber via the inlet 88 will flow more directly toward the outlet.

Multiple cup-like structures 94 are distributed about the chamber 84 in the FIG. 10 configuration, and multiple structures are located in the chamber in the FIG. 11 configuration. These structures 94 can increasingly impede circular flow of the fluid composition 36 about the outlet 40 when the fluid composition has a decreased velocity, increased viscosity and/or decreased density. In this manner, the structures 94 can function to stabilize the flow of relatively low velocity, high viscosity and/or low density fluid in the chamber 84, even though the structures do not significantly impede circular flow of relatively high velocity, low viscosity and/or high density fluid about the outlet 40.

Many other possibilities exist for the placement, configuration, number, etc. of the structures 94 in the chamber 84. For example, the structures 94 could be aerofoil-shaped or cylinder-shaped, the structures could comprise grooves oriented radially relative to the outlet 40, etc. Any arrangement, position and/or combination of structures 94 may be used in keeping with the principles of this disclosure.

It may now be fully appreciated that this disclosure provides several advancements to the art of regulating fluid flow in a subterranean well. The various configurations of the variable flow resistance system 25 described above enable control of desired and undesired fluids in a well, without use of complex, expensive or failure-prone mechanisms. Instead, the system 25 is relatively straightforward and inexpensive to produce, operate and maintain, and is reliable in operation.

The above disclosure provides to the art a variable flow resistance system 25 for use in a subterranean well. The system 25 includes a flow chamber 84 through which a fluid composition 36 flows. The chamber 84 has at least one inlet 86, 88, an outlet 40, and at least one structure 94 which impedes a change from circular flow of the fluid composition 36 about the outlet 40 to radial flow toward the outlet 40.

The fluid composition 36 can flow through the flow chamber 84 in the well.

The structure 94 can increasingly impede a change from circular flow of the fluid composition 36 about the outlet 40 to radial flow toward the outlet 40 in response to at least one of a) increased velocity of the fluid composition 36, b) decreased viscosity of the fluid composition 36, c) increased density of the fluid composition 36, d) a reduced ratio of desired fluid to undesired fluid in the fluid composition 36, e) decreased angle of entry of the fluid composition 36 into the chamber 84, and f) more substantial impingement of the fluid composition 36 on the structure 94.

The structure 94 may have at least one opening 96 which permits the fluid composition 36 to change direction and flow more directly from the inlet 86, 88 to the outlet 40.

The at least one inlet can comprise at least first and second inlets, wherein the first inlet 88 directs the fluid composition 36 to flow more directly toward the outlet 40 of the chamber 84 as compared to the second inlet 86.

The at least one inlet can comprises only a single inlet 86.

The structure 94 may comprise at least one of a vane and a recess.

The structure 94 may project at least one of inwardly and outwardly relative to a wall 98, 100 of the chamber 84.

The fluid composition 36 may enter the chamber 84 via the inlet 86, 88 in a direction which changes based on a ratio of desired fluid to undesired fluid in the fluid composition 36.

The fluid composition 36 may flow more directly from the inlet 86, 88 to the outlet 40 as the viscosity of the fluid composition 36 increases, as the velocity of the fluid composition 36 decreases, as the density of the fluid composition 36 decreases, as the ratio of desired fluid to undesired fluid in the fluid composition 36 increases, and/or as an angle of entry of the fluid composition 36 increases.

The structure 94 may reduce or increase the velocity of the fluid composition 36 as it flows from the inlet 86 to the outlet 40.

The above disclosure also provides to the art a variable flow resistance system 25 which comprises a flow chamber 84 through which a fluid composition 36 flows. The chamber 84 has at least one inlet 86, 88, an outlet 40, and at least one structure 94 which impedes circular flow of the fluid composition 36 about the outlet 40.

Also described above is a variable flow resistance system 25 for use in a subterranean well, with the system comprising a flow chamber 84 including an outlet 40 and at least one structure 94 which resists a change in a direction of flow of a fluid composition 36 toward the outlet 40. The fluid composition 36 enters the chamber 84 in a direction of flow which changes based on a ratio of desired fluid to undesired fluid in the fluid composition 36.

The fluid composition 36 may exit the chamber via the outlet 40 in a direction which changes based on a ratio of desired fluid to undesired fluid in the fluid composition 36.

The structure 94 can impede a change from circular flow of the fluid composition 36 about the outlet 40 to radial flow toward the outlet 40.

The structure 94 may have at least one opening 96 which permits the fluid composition 36 to flow directly from a first inlet 88 of the chamber 84 to the outlet 40. The first inlet 88 can direct the fluid composition 36 to flow more directly toward the outlet 40 of the chamber 84 as compared to a second inlet 86.

The opening 96 in the structure 94 may permit direct flow of the fluid composition 36 from the first inlet 88 to the outlet 40. In one example described above, the chamber 84 includes only one inlet 86.

The structure 94 may comprise a vane or a recess. The structure 94 can project inwardly or outwardly relative to one or more walls 98, 100 of the chamber 84.

The fluid composition 36 may flow more directly from an inlet 86 of the chamber 84 to the outlet 40 as a viscosity of the fluid composition 36 increases, as a velocity of the fluid composition 36 decreases, as a density of the fluid composition 36 increases, as a ratio of desired fluid to undesired fluid in the fluid composition 36 increases, as an angle of entry of the fluid composition 36 increases, and/or as the fluid composition 36 impingement on the structure 94 decreases.

The structure 94 may induce portions of the fluid composition 36 which flow circularly about the outlet 40 to continue to flow circularly about the outlet 40. The structure 94 preferably impedes a change from circular flow of the fluid composition 36 about the outlet 40 to radial flow toward the outlet 40.

Also described by the above disclosure is a variable flow resistance system 25 which includes a flow chamber 84 through which a fluid composition 36 flows. The chamber 84 has at least one inlet 86, 88, an outlet 40, and at least one structure 94 which impedes a change from circular flow of the fluid composition 36 about the outlet 40 to radial flow toward the outlet 40.

The above disclosure also describes a variable flow resistance system 25 which includes a flow path selection device 52 that selects which of multiple flow paths 58, 60 a majority of fluid flows through from the device 52, based on a ratio of desired fluid to undesired fluid in a fluid composition 36. A flow chamber 84 of the system 25 includes an outlet 40, a first inlet 88 connected to a first one of the flow paths 60, a second inlet 86 connected to a second one of the flow paths 58, and at least one structure 94 which impedes radial flow of the fluid composition 36 from the second inlet 86 to the outlet 40 more than it impedes radial flow of the fluid composition 36 from the first inlet 88 to the outlet 40.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A variable flow resistance system for use in a subterranean well, the system comprising:

a flow chamber through which a fluid composition flows, the chamber having at least one inlet through which the fluid composition enters the chamber, an outlet through which the same fluid composition exits the chamber, and at least one structure which impedes a change from circular flow of the fluid composition about the outlet to radial flow toward the outlet.

2. The system of claim 1, wherein the fluid composition flows through the flow chamber when the flow chamber is positioned in the well.

3. The system of claim 1, wherein the structure increasingly impedes the change from circular flow of the fluid composition about the outlet to radial flow toward the outlet in response to at least one of a) increased velocity of the fluid composition, b) decreased viscosity of the fluid composition, c) a reduced ratio of desired fluid to undesired fluid in the fluid composition, d) a decreased angle of entry of the fluid composition into the flow chamber, and e) an increased impingement of the fluid composition on the structure.

4. The system of claim 1, wherein the at least one inlet comprises only a single inlet.

5. The system of claim 1, wherein the structure comprises at least one of a vane and a recess.

6. The system of claim 1, wherein the structure projects at least one of inwardly and outwardly relative to a wall of the chamber.

7. The system of claim 1, wherein the fluid composition flows through the chamber toward the outlet in a direction which changes based on a ratio of desired fluid to undesired fluid in the fluid composition.

8. The system of claim 1, wherein the fluid composition flows more directly from the inlet to the outlet as a viscosity of the fluid composition increases.

9. The system of claim 1, wherein the fluid composition flows more directly from the inlet to the outlet as a velocity of the fluid composition decreases.

10. The system of claim 1, wherein the fluid composition flows more directly from the inlet to the outlet as an angle of entry of the fluid composition increases.

11. The system of claim 1, wherein the fluid composition flows more directly from the inlet to the outlet as a ratio of desired fluid to undesired fluid in the fluid composition increases.

12. The system of claim 1, wherein the structure increases a velocity of the fluid composition as the fluid composition flows from the inlet to the outlet.

13. A variable flow resistance system for use in a subterranean well, the system comprising:

a flow chamber through which a fluid composition flows, the chamber having a substantially cylindrical perimeter wall;

at least one inlet through which the fluid composition enters the chamber, the inlet intersecting the perimeter wall;

an outlet through which the fluid composition exits the chamber, the outlet being proximate a center of the chamber; and at least one structure which impedes circular flow of the fluid composition about the outlet.

14. The system of claim 13, wherein the fluid composition flows through the flow chamber when the flow chamber is positioned in the well.

15. The system of claim 13, wherein the structure increasingly impedes the circular flow of the fluid composition about the outlet in response to at least one of a) decreased velocity of the fluid composition, b) increased viscosity of the fluid composition, c) an increased ratio of desired fluid to undesired fluid in the fluid composition, d) a decreased angle of entry of the fluid composition into the flow chamber, and e) an increased impingement of the fluid composition on the structure.

16. The system of claim 13, wherein the structure has at least one opening which permits the fluid composition to change direction and flow more directly from the inlet to the outlet.

17. The system of claim 13, wherein the at least one inlet comprises at least first and second inlets, and wherein the first inlet directs the fluid composition to flow more directly toward the outlet of the chamber as compared to the second inlet.

18. The system of claim 13, wherein the at least one inlet comprises a single inlet.

19. The system of claim 13, wherein the structure comprises at least one of a vane and a recess.

20. The system of claim 13, wherein the structure projects at least one of inwardly and outwardly relative to a wall of the chamber.

21. The system of claim 13, wherein the fluid composition flows through the chamber toward the outlet in a direction which changes based on a ratio of desired fluid to undesired fluid in the fluid composition.

22. The system of claim 13, wherein the fluid composition flows more directly from the inlet to the outlet as the viscosity of the fluid composition increases.

23. The system of claim 13, wherein the fluid composition flows more directly from the inlet to the outlet as a velocity of the fluid composition decreases.

24. The system of claim 13, wherein the fluid composition flows more directly from the inlet to the outlet as an angle of entry of the fluid composition increases.

25. The system of claim 13, wherein the fluid composition flows more directly from the inlet to the outlet as a ratio of desired fluid to undesired fluid in the fluid composition increases.

26. The system of claim 13, wherein the structure reduces a velocity of the fluid composition as the fluid composition flows from the inlet to the outlet.

27. A variable flow resistance system for use in a subterranean well, the system comprising:

a flow chamber including at least one inlet through which a fluid composition enters the chamber, an outlet through which the same fluid composition exits the chamber, and at least one structure which resists a change in a direction of flow of the fluid composition toward the outlet, wherein the direction of flow of the fluid composition toward the outlet changes based on a ratio of desired fluid to undesired fluid in the fluid composition.

28. The system of claim 27, wherein the structure impedes a change from circular flow of the fluid composition about the outlet to radial flow toward the outlet.

29. The system of claim 27, wherein the structure has at least one opening which permits a change from circular flow of the fluid composition about the outlet to radial flow toward the outlet.

30. The system of claim 29, wherein the opening in the structure permits more direct flow of the fluid composition toward the outlet.

31. The system of claim 27, wherein the fluid composition flows into the chamber only via one inlet.

32. The system of claim 27, wherein the structure comprises at least one of a vane and a recess.

33. The system of claim 27, wherein the structure projects at least one of inwardly and outwardly relative to a wall of the chamber.

34. The system of claim 27, wherein the fluid composition flows more directly toward the outlet as a viscosity of the fluid composition increases.

35. The system of claim 27, wherein the fluid composition flows more directly toward the outlet as a velocity of the fluid composition decreases.

36. The system of claim 27, wherein the fluid composition flows more directly toward the outlet as an angle of entry of the fluid composition increases.

37. The system of claim 27, wherein the fluid composition flows more directly toward the outlet as a ratio of desired fluid to undesired fluid in the fluid composition increases.

38. The system of claim 27, wherein the structure increasingly impedes a change in direction of the fluid composition from circular flow of the fluid composition about the outlet to radial flow toward the outlet as at least one of a velocity of the fluid composition increases, a viscosity of the fluid composition decreases, an angle of entry of the fluid composition decreases, a ratio of desired fluid to undesired fluid decreases, and impingement of the fluid composition on the structure increases.

39. The system of claim 27, wherein the structure increasingly causes a change in direction of the fluid composition from circular flow of the fluid composition about the outlet to radial flow toward the outlet as at least one of a velocity of the fluid composition decreases, a viscosity of the fluid composition increases, an angle of entry of the fluid composition increases and a ratio of desired fluid to undesired fluid increases.

40. The system of claim 27, wherein the structure increases a velocity of the fluid composition as the fluid composition flows toward the outlet.

41. The system of claim 27, wherein the structure reduces a velocity of the fluid composition as the fluid composition flows toward the outlet.

42. A variable flow resistance system for use in a subterranean well, the system comprising:

a flow path selection device that selects which of multiple flow paths a majority of fluid flows through from the device, based on a ratio of desired fluid to undesired fluid in a fluid composition; and a flow chamber having an outlet, a first inlet connected to a first one of the flow paths, a second inlet connected to a second one of the flow paths, and at least one structure which impedes radial flow of the fluid composition from the second inlet to the outlet more than the structure impedes radial flow of the fluid composition from the first inlet to the outlet.

43. The system of claim 42, wherein the structure has at least one opening which permits the fluid composition to change direction and flow more directly from the first inlet to the outlet.

44. The system of claim 42, wherein the first inlet directs the fluid composition to flow more directly toward the outlet of the chamber as compared to the second inlet.

45. The system of claim 42, wherein the structure comprises at least one of a vane and a recess.

46. The system of claim 42, wherein the structure projects at least one of inwardly and outwardly relative to a wall of the chamber.

47. The system of claim 42, wherein the structure induces portions of the fluid composition which flow circularly about the outlet to continue to flow circularly about the outlet.

48. The system of claim 42, wherein the structure increasingly impedes a change from circular flow of the fluid composition about the outlet to radial flow toward the outlet in response to at least one of a) increased velocity of the fluid composition, b) decreased viscosity of the fluid composition, c) a reduced ratio of desired fluid to undesired fluid in the fluid composition, d) decreased angle of entry of the fluid composition, and e) increased impingement of the fluid composition on the structure.

49. The system of claim 42, wherein a structure in the chamber increases a velocity of the fluid composition as the fluid composition flows to the outlet.

50. A variable flow resistance system for use in a subterranean well, the system comprising:

a flow chamber including an outlet and at least one structure which resists a change in a direction of flow of a fluid composition toward the outlet, wherein the fluid composition enters the chamber in the direction of flow which changes based on a ratio of desired fluid to undesired fluid in the fluid composition, wherein the structure has at least one opening which permits a change from circular flow of the fluid composition about the outlet to radial flow toward the outlet, and wherein the opening in the structure permits more direct flow of the fluid composition from an inlet to the outlet.

51. The system of claim 50, wherein the fluid composition flows into the chamber only via the inlet.

52. A variable flow resistance system for use in a subterranean well, the system comprising:

a flow chamber including an outlet and at least one structure which resists a change in a direction of flow of a fluid composition toward the outlet, wherein the fluid composition enters the chamber in the direction of flow which changes based on a ratio of desired fluid to undesired fluid in the fluid composition, and wherein the structure reduces a velocity of the fluid composition as the fluid composition flows from an inlet to the outlet.

* * * * *